US011313054B2

(12) United States Patent
Matsumoto et al.

(10) Patent No.: US 11,313,054 B2
(45) Date of Patent: Apr. 26, 2022

(54) CARBON FIBER BUNDLE

(71) Applicant: Toray Industries, Inc., Tokyo (JP)

(72) Inventors: Naohiro Matsumoto, Ehime (JP); Takaaki Yamashita, Ehime (JP); Fumihiko Tanaka, Ehime (JP)

(73) Assignee: Toray Industries, Inc., Tokyo (JP)

( * ) Notice: Subject to any disclaimer, the term of this patent is extended or adjusted under 35 U.S.C. 154(b) by 191 days.

(21) Appl. No.: 16/099,951

(22) PCT Filed: May 16, 2017

(86) PCT No.: PCT/JP2017/018280
§ 371 (c)(1),
(2) Date: Nov. 8, 2018

(87) PCT Pub. No.: WO2017/204026
PCT Pub. Date: Nov. 30, 2017

(65) Prior Publication Data

US 2019/0136417 A1 May 9, 2019

(30) Foreign Application Priority Data

May 24, 2016 (JP) ..... JP2016-102981

(51) Int. Cl.
*D01F 9/22* (2006.01)
*D01F 9/12* (2006.01)

(52) U.S. Cl.
CPC ..... *D01F 9/225* (2013.01); *D01F 9/22* (2013.01); *D01F 9/12* (2013.01);
(Continued)

(58) Field of Classification Search
CPC ..... D01F 6/18; D01F 9/12; D01F 9/22; D01F 9/225; Y10T 428/249945; Y10T 428/29;
(Continued)

(56) References Cited

U.S. PATENT DOCUMENTS 10,023,979 B2 7/2018 Matsumoto et al.
2001/0024722 A1 9/2001 Matsuhisa et al.
(Continued)

FOREIGN PATENT DOCUMENTS

CN 101861416 A 10/2010
CN 104662214 A 5/2015
(Continued)

OTHER PUBLICATIONS

Chinese Office Action dated Jun. 30, 2020, of counterpart Chinese Application No. 201780029955.1, along with a Search Report in English.
(Continued)

*Primary Examiner* — Matthew D Matzek
(74) *Attorney, Agent, or Firm* — DLA Piper LLP (US)

(57) ABSTRACT

A carbon fiber bundle from which a carbon fiber composite material having high tensile strength can be obtained has the following configuration. Specifically, the carbon fiber bundle has a strand elastic modulus of 265-300 GPa, strand strength of at least 6.0 GPa, and knot strength of at least 820 N/mm$^2$, and includes at least 30,000 filaments.

16 Claims, 1 Drawing Sheet

(52) U.S. Cl.
CPC .... *Y10T 428/249945* (2015.04); *Y10T 428/29* (2015.01); *Y10T 428/292* (2015.01); *Y10T 428/2918* (2015.01)

(58) Field of Classification Search
CPC ..... Y10T 428/293; Y10T 428/2918; Y10T 428/292; C01B 2/00; C01B 2/05; D10B 2101/12; D06B 1/00; D06B 3/00; D06B 5/00
USPC ..... 428/367
See application file for complete search history.

(56) References Cited

U.S. PATENT DOCUMENTS

| | | | | |
|---|---|---|---|---|
| 2010/0252438 | A1 | 10/2010 | Yoshikawa et al. | |
| 2012/0088103 | A1* | 4/2012 | Sugiura | D01F 6/18 428/367 |
| 2012/0088104 | A1 | 4/2012 | Hashimoto et al. | |
| 2015/0114262 | A1 | 4/2015 | Kiriyama et al. | |
| 2015/0274860 | A1 | 10/2015 | Sako et al. | |
| 2015/0361591 | A1* | 12/2015 | Watanabe | D01F 9/22 523/435 |
| 2016/0060793 | A1 | 3/2016 | Sugiura et al. | |
| 2017/0342602 | A1 | 11/2017 | Matsumoto et al. | |

FOREIGN PATENT DOCUMENTS

| | | | | |
|---|---|---|---|---|
| CN | 104937150 | A | | 9/2015 |
| JP | 58-163729 | A | | 9/1983 |
| JP | 62-257422 | A | | 11/1987 |
| JP | 6-294020 | A | | 10/1994 |
| JP | 2005-60871 | A | | 3/2005 |
| JP | 2005-113296 | A | | 4/2005 |
| JP | 2010-285710 | A | | 12/2010 |
| JP | 2010285710 | A | * | 12/2010 |
| JP | 2012-82541 | A | | 4/2012 |
| JP | 2012-154000 | A | | 8/2012 |
| JP | 2013-23778 | A | | 2/2013 |
| JP | 2014-141763 | A | | 8/2014 |
| JP | 2014-159564 | A | | 9/2014 |
| JP | 2014-159664 | A | | 9/2014 |
| JP | 2015-10290 | A | | 1/2015 |
| JP | 2015-96664 | A | | 5/2015 |
| JP | 5907321 | B1 | | 4/2016 |
| WO | 97/45576 | A1 | | 12/1997 |
| WO | 2010/143680 | A1 | | 12/2010 |
| WO | 2010/143681 | A1 | | 12/2010 |
| WO | 2013/157613 | A1 | | 10/2013 |
| WO | WO-2014115762 | A1 | * | 7/2014 ..... D01F 11/14 |
| WO | 2016/068034 | A1 | | 5/2016 |

OTHER PUBLICATIONS

Chinese Office Action dated May 7, 2021, of counterpart Chinese Application No. 201780029955.1, along with a Search Report in English.

* cited by examiner

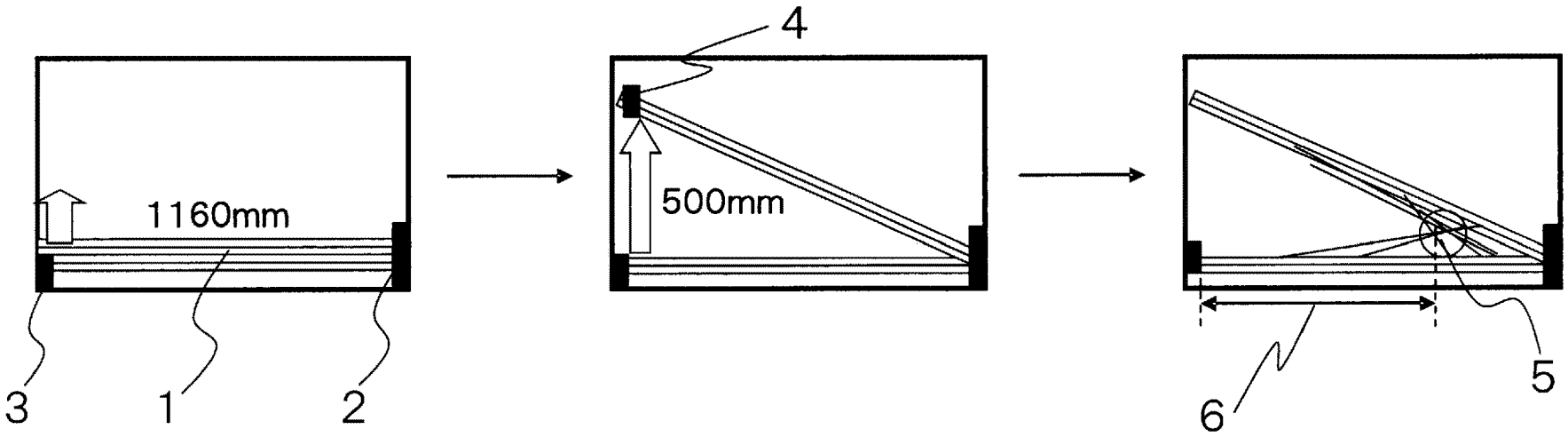
1160mm
500mm
1
2
3
4
5
6

CARBON FIBER BUNDLE

TECHNICAL FIELD

This disclosure relates to a carbon fiber bundle and a method of manufacturing the same.

BACKGROUND

Carbon fibers have been widely used for various applications as fillers for composites, and are strongly required to exhibit high tensile strength when made into composites. In general, to exhibit excellent tensile strength as a composite, it is important that the carbon fiber bundle have a high tensile strength of resin-impregnated strands and a high tensile modulus of resin-impregnated strands. Thus, carbon fiber bundles having a number of filaments less than 30,000 are mainly produced.

In a brittle material such as carbon fibers, it is possible to increase the tensile strength of resin-impregnated strands of the carbon fiber bundle by decreasing the flaw size of carbon fibers according to the Griffith equation or increasing the fracture toughness of carbon fibers. In particular, improvement of the fracture toughness of carbon fibers is effective in that the tensile strength of resin-impregnated strands of the carbon fiber bundle can be increased independent of the flaw size of carbon fibers (International Publication No. 97/45576). Further, improvement of the fracture toughness of carbon fibers is effective also in that it is possible to efficiently increase the tensile strength of the carbon fiber-reinforced composite obtained using the carbon fibers, and to reduce fuzz that lowers the tensile strength of the composite.

Until now, as a method of improving the tensile strength of resin-impregnated strands and the tensile modulus of resin-impregnated strands of the carbon fiber bundle, there have been proposed a method of increasing the stabilization temperature using a plurality of ovens having different temperatures in the stabilization process, and a method of extending, in oxidation ovens composed of a plurality of ovens, precursor fibers for carbon fiber that have passed through the ovens according to the density thereof (Japanese Patent Laid-open Publication No. 58-163729, Japanese Patent Laid-open Publication No. 6-294020, Japanese Patent Laid-open Publication No. 62-257422 and Japanese Patent Laid-open Publication No. 2013-23778). There is also proposed a method of performing temperature control in two or three temperature control regions different in temperature in the stabilization process (Japanese Patent Laid-open Publication No. 2012-82541).

In addition, a carbon fiber bundle having a large number of filaments and excellent in productivity has been proposed (Japanese Patent Laid-open Publication No. 2005-113296, Japanese Patent Laid-open Publication No. 2005-60871 and Japanese Patent Laid-open Publication No. 2012-154000).

Further, there has also been proposed a carbon fiber bundle having high knot strength, the carbon fiber bundle reflecting mechanical performance of the carbon fiber bundle in a direction other than the fiber axis direction, and exhibiting sufficient mechanical performance in a pseudo-isotropic material (Japanese Patent Laid-open Publication No. 2015-96664 and International Publication No. 2013/157613).

It is important to increase the fracture toughness of carbon fibers. To increase the fracture toughness, control of a microstructure of carbon fibers is essentially important. The proposal of International Publication No. 97/45576 is merely aimed at controlling the silicone oil agent, the single-fiber fineness, and the difference between skin-core structure, and improving the physical properties through the control of surface flaws or control of microstructure distribution of carbon fibers, and is not aimed at improving the microstructure itself.

In the proposal of Japanese Patent Laid-open Publication No. 58-163729, the number of temperature control regions in the stabilization process is two or three, and the carbon fiber bundle is to be treated at a temperature as high as possible in the regions. The treatment time, however, is as long as 44 to 60 minutes, and that technique does not achieve the control of the microstructure region of the carbon fibers. In the proposal of Japanese Patent Laid-open Publication No. 6-294020, the number of temperature control regions in the stabilization process is two or three, and the heat treatment time in the high temperature region is prolonged to achieve the stabilization in a short time. Therefore, that technique is inadequate in that the stabilization time at high temperature is long, and that the fiber structure at the initial stage of the stabilization is not controlled. The proposal of Japanese Patent Laid-open Publication No. 62-257422 requires three to six ovens to set a plurality of degrees of extension in the oxidation ovens or to shorten the stabilization time, but does not achieve satisfactory control of the microstructure of carbon fibers. The proposal of Japanese Patent Laid-open Publication No. 2013-23778 is to set the specific gravity of fibers in the middle of the stabilization process to 1.27 or more and then heat-treat the carbon fiber bundle at 280 to 400° C. for 10 to 120 seconds. That technique, however, does not achieve satisfactory control of the microstructure of carbon fibers merely by treating the carbon fiber bundle at a high temperature at the very last stage of the heat treatment. The proposal of Japanese Patent Laid-open Publication No. 2012-82541 is a technique of controlling the specific gravity of the stabilized yarn after the first oxidation oven to 1.27 or more, and does not achieve satisfactory control of the microstructure.

The proposal of Japanese Patent Laid-open Publication No. 2005-113296 is a technique in which a yarn is wet-spun from a spinneret having a large number of holes, and the stretch ratio in the spinning process is controlled. In that technique, however, the level of the tensile strength of resin-impregnated strands is low, and it is impossible to provide a composite that exhibits excellent tensile strength. Although the proposal of Japanese Patent Laid-open Publication No. 2005-60871 is a method of efficiently stabilizing a precursor fiber bundle for carbon fiber having a large number of filaments, the level of the tensile strength of resin-impregnated strands is low, and it is impossible to provide a composite that exhibits excellent tensile strength. The proposal of Japanese Patent Laid-open Publication No. 2012-154000 is highly suitable for filament winding because of the stable width of fiber bundle at the time of unwinding although the number of filaments is large. That technique, however, does not achieve the control of the microstructure to control the fracture toughness of the carbon fiber bundle, and it does not mention the knot strength and the coefficient of variation thereof.

Although the proposal of Japanese Patent Laid-open Publication No. 2015-96664 describes that the carbon fiber bundle has high knot strength mainly due to adjustment of the surface treatment of the carbon fiber bundle and the sizing agent, it does not mention the number of filaments of the carbon fiber bundle, and the number of filaments is only 24,000 even in the examples. Since the knot strength decreases as the number of filaments of the carbon fiber bundle is increased to enhance the uniformity as the carbon fiber bundle, that technique is incapable of achieving both the number of filaments and the knot strength of the carbon fiber bundle.

Although the proposal of International Publication No. 2013/157613 describes achieving a high knot strength mainly due to adjustment of the stabilization conditions even though the number of filaments is large and the fiber diameter is large, that technique is inadequate in that the knot strength in the examples is 510 N/mm$^2$ or less.

It could therefore be helpful to provide a carbon fiber bundle capable of providing a carbon fiber-reinforced composite having high tensile strength, and a method of manufacturing the same.

SUMMARY

We caused the heat treatment to be uniform and improved the fracture toughness of the single fibers while increasing the number of filaments to significantly improve production efficiency. As a result, we increased the tensile strength of resin-impregnated strands to a level not achieved with conventional carbon fiber bundles, and found a method of obtaining a high-quality carbon fiber bundle.

We thus provide:

A carbon fiber bundle having a tensile modulus of resin-impregnated strands of 265 to 300 GPa, a tensile strength of resin-impregnated strands of 6.0 GPa or more, a knot strength of 820 N/mm$^2$ or more, and a number of filaments of 30,000 or more.

Preferably, the knot strength is 900 N/mm$^2$ or more, the coefficient of variation represented by the ratio of the standard deviation to the average of the knot strength is 6% or less, more preferably 5% or less, the product E×d/W is 13.0 GPa or more, wherein d/W is the ratio of the single-fiber diameter d to the loop diameter W just before loop fracture as evaluated by a single-fiber loop test, and E is the tensile modulus of resin-impregnated strands, the Weibull shape parameter m in the Weibull plot of E×d/W is 12 or more, and the average tearable length is 600 to 900 mm.

Such a carbon fiber bundle is suitably obtained by a method of manufacturing a carbon fiber bundle, including: a first stabilization process of stabilizing a polyacrylonitrile precursor fiber bundle for carbon fiber having a number of filaments of 30,000 or more and an average tearable length of 400 to 800 mm for 8 to 25 minutes until the ratio of the peak intensity at 1453 cm$^{-1}$ to the peak intensity at 1370 cm$^{-1}$ in the infrared spectrum is 0.98 to 1.10 to give a fiber bundle; a second stabilization process of stabilizing the fiber bundle obtained in the first stabilization process for 20 to 35 minutes until the ratio of the peak intensity at 1453 cm$^{-1}$ to the peak intensity at 1370 cm$^{-1}$ in the infrared spectrum is 0.60 to 0.65 and the ratio of the peak intensity at 1254 cm$^{-1}$ to the peak intensity at 1370 cm$^{-1}$ in the infrared spectrum is 0.50 to 0.65; a pre-carbonization process of pre-carbonizing the fiber bundle obtained in the second stabilization process in an inert atmosphere having a maximum temperature of 500 to 1000° C. at a stretch ratio of 1.00 to 1.10; and a carbonization process of carbonizing the fiber bundle obtained in the pre-carbonization process in an inert atmosphere having a maximum temperature of 1000 to 2000° C.

The carbon fiber bundle is a carbon fiber bundle capable of providing a high-performance carbon fiber-reinforced composite that exhibits excellent tensile strength even with use of a carbon fiber bundle having a large number of filaments.

In addition, according to the method of manufacturing a carbon fiber bundle, it is possible to obtain the carbon fiber bundle.

BRIEF DESCRIPTION OF THE DRAWING

The drawing shows a method of measuring the average tearable length.

DESCRIPTION OF REFERENCE SIGNS

1: Fiber bundle
2: Fixed point A
3: Fixed point B
4: Fixed point C
5: Entanglement point
6: Tearable length

DETAILED DESCRIPTION

The carbon fiber bundle has a tensile modulus of resin-impregnated strands of 265 to 300 GPa, a tensile strength of resin-impregnated strands of 6.0 GPa or more, a knot strength of 820 N/mm$^2$ or more, and a number of filaments of 30,000 or more.

The carbon fiber bundle has a number of filaments of 30,000 or more. The number of filaments is preferably 35,000 or more. In the manufacture of a composite by filament winding, the productivity depends on the processing speed of the fiber bundle and the number of filaments. Therefore, a large number of filaments enable efficient manufacture of the composite. A number of filaments of 30,000 or more is satisfactory from the viewpoint of productivity.

The carbon fiber bundle has a tensile modulus of resin-impregnated strands of 265 to 300 GPa. The tensile modulus of resin-impregnated strands is preferably 270 to 295 GPa, more preferably 275 to 290 GPa. When the tensile modulus of resin-impregnated strands is 265 to 300 GPa, the carbon fiber bundle is excellent in the balance between the tensile modulus of resin-impregnated strands and the tensile strength of resin-impregnated strands. In particular, a tensile modulus of resin-impregnated strands controlled to 275 to 290 GPa easily provides a carbon fiber bundle excellent in tensile strength of resin-impregnated strands. The tensile modulus of resin-impregnated strands refers to the tensile modulus determined by the method described in the resin-impregnated strand tensile test (hereinafter, strand tensile test) of a carbon fiber bundle described later. In the test, the range of strain is 0.1 to 0.6%. The tensile modulus of resin-impregnated strands of the carbon fiber bundle can be controlled mainly by applying tension to the fiber bundle or changing the carbonization temperature in any of heat treatment processes in the manufacturing process of the carbon fiber bundle.

The carbon fiber bundle has a tensile strength of resin-impregnated strands of 6.0 GPa or more. The tensile strength of resin-impregnated strands is preferably 6.2 GPa or more, more preferably 6.4 GPa or more. When the tensile strength of resin-impregnated strands is 6.0 GPa or more, a composite manufactured from the carbon fiber bundle has a potential to exhibit satisfactory tensile strength. The tensile strength of resin-impregnated strands refers to the tensile strength determined by the method described in the strand tensile test of a carbon fiber bundle described later. In addition, the parameter can be controlled by using the method of manufacturing a carbon fiber bundle described later.

The carbon fiber bundle has a knot strength of 820 $N/mm^2$ or more. The knot strength is preferably 850 $N/mm^2$ or more, more preferably 900 $N/mm^2$ or more. The knot strength refers to the fiber bundle tensile strength obtained by subjecting a carbon fiber bundle having a knot made at the midpoint thereof to a fiber bundle tensile test. The knot strength is obtained by the method described in "Knot strength and coefficient of variation thereof of carbon fiber bundle" described later. The knot strength is an indicator reflecting the mechanical properties of the fiber bundle other than in the fiber axis direction. In the manufacture of a composite, bending stress is applied to the carbon fiber bundle other than in the fiber axis direction, and the knot strength affects generation of fuzz that is fiber fracture generated during the manufacturing process of the composite. When the number of filaments is increased to efficiently manufacture a composite, fuzz is generated and it tends to be difficult to increase the processing speed of the fiber bundle during the manufacture of the composite. However, high knot strength enables manufacture of a high-quality composite even under conditions where the processing speed of the fiber bundle is high. When the knot strength is 820 $N/mm^2$ or more, it is possible to reduce fuzz due to abrasion with a guide part or a roller and increase the processing speed of the fiber bundle during the filament winding process. To increase the knot strength of the carbon fiber bundle, it is preferable to control the structural parameters particularly in the stabilization processes and the pre-carbonization process within preferable ranges in the method of manufacturing a carbon fiber bundle described later.

The carbon fiber bundle preferably has a coefficient of variation represented by the ratio of the standard deviation to the average of the knot strength of 6% or less. The coefficient of variation is more preferably 5% or less, still more preferably 4% or less, particularly preferably 2% or less. In the filament winding process, when the coefficient of variation of the knot strength is high, fuzz is likely to be generated at the portion where the variation of the knot strength is large, and it tends to be difficult to increase the processing speed of the fiber bundle during the manufacture of the composite. However, a low coefficient of variation of the knot strength can provide a high-quality composite. The coefficient of variation of the knot strength is preferably 6% or less, more preferably 5% or less, still more preferably 4% or less. In this case, fuzzing in the common filament winding process can be sufficiently suppressed. The lower limit of the coefficient of variation of the knot strength is not particularly limited, and a lower coefficient of variation is capable of more effectively suppressing fuzz and improving the production efficiency. However, since the effect of suppressing fuzz is saturated at a coefficient of variation of the knot strength of about 2%, generation of fuzz can be effectively suppressed by controlling the coefficient of variation of the knot strength to 2% or less. The coefficient of variation of the knot strength can be obtained by the method described in "Knot strength and coefficient of variation thereof of carbon fiber bundle" described later.

The carbon fiber bundle preferably has a product E×d/W of 13.0 GPa or more, wherein d/W is the ratio of the single-fiber diameter d to the loop diameter W just before loop fracture as evaluated by a single-fiber loop test, and E is the tensile modulus of resin-impregnated strands. E×d/W is more preferably 13.3 GPa or more, still more preferably 13.5 GPa or more. The single-fiber loop test is a technique of investigating the relation between the strain given to a single fiber and a fracture behavior such as single fiber fracture and buckling by deforming the single fiber into a loop shape. When a single fiber is deformed into a loop shape, compressive strain is given to the inside of the single fiber, and tensile strain is given to the outside of the single fiber. Since compression buckling occurs before tensile fracture, the single-fiber loop test is conventionally often used as a test method for the single fiber compression strength of carbon fibers. The single-fiber loop test, however, can be used to evaluate a value regarded as the intrinsic bending strength of carbon fibers since the test evaluates the fracture strain. That is, d/W is a value proportional to strain, and the product of the value of d/W and the tensile modulus of resin-impregnated strands, E, described above is a value corresponding to the strength of the single fiber. Although the tensile strength of the composite is sometimes not increased even if merely the tensile strength of resin-impregnated strands of the carbon fiber bundle is increased, the tensile strength of the composite can be effectively increased by increasing the value of E×d/W. The upper limit of E×d/W is not particularly limited, and it is sufficient to set the upper limit of E×d/W to 19.0 GPa. In addition, the parameter can be controlled by using the method of manufacturing a carbon fiber bundle.

The carbon fiber bundle preferably has a Weibull shape parameter m in the Weibull plot of E×d/W of 12 or more. The Weibull shape parameter m is more preferably 15 or more, still more preferably 17 or more. The Weibull plot is a technique widely used to evaluate the strength distribution, and the Weibull shape parameter m tells the shape of the distribution. The Weibull plot is evaluated for twenty single fibers. The single fibers are numbered as 1, . . . , i, . . . , and 20 in the order of the smallest value to the largest value of E×d/W, and the numbers are plotted with $\ln(-\ln(1-(i-0.5)/20))$ as the ordinate and $\ln(E\times d/W)$ as the abscissa. Herein, ln means a natural logarithm. When the plot is linearly approximated by the least squares method, the Weibull shape parameter m is obtained as the slope of the line. The larger the Weibull shape parameter m is, the narrower the distribution is, and the smaller the Weibull shape parameter m is, the wider the strength distribution is. In a general carbon fiber bundle, the Weibull shape parameter m of the single-fiber strength evaluated by a single fiber tensile test often has a value around 5. Such a value is derived from the wide distribution of flaw sizes. Meanwhile, although the detailed reason is not necessarily clear, in the carbon fiber bundle, the Weibull shape parameter m of E×d/W is significantly larger than the value around 5, and a Weibull shape parameter m of 12 or more often makes it possible to manufacture a composite having excellent tensile strength.

The carbon fiber bundle preferably has a product E×d/W of 13.0 GPa or more, and a Weibull shape parameter m in the Weibull plot of E×d/W of 12 or more, wherein d/W is the ratio of the single-fiber diameter d to the loop diameter W just before loop fracture as evaluated by a single-fiber loop test, and E is the tensile modulus of resin-impregnated strands. When the carbon fiber bundle simultaneously satisfies both of these conditions, a composite having particularly excellent tensile strength can be obtained.

The carbon fiber bundle preferably has an average tearable length of 600 to 900 mm. The average tearable length is more preferably 700 to 900 mm. The average tearable length is an indicator showing the degree of entanglement in a certain fiber bundle. As the fiber bundle is strongly entangled uniformly, the average tearable length is shorter, and when there is no entanglement or the fiber bundle is entangled nonuniformly, the average tearable length is longer. When the carbon fiber bundle is strongly entangled uniformly, it is possible to increase the strength of the carbon fiber bundle in a long gauge length on the order of several meters. Therefore, when the average tearable length of the carbon fiber bundle is 900 mm or less, it is possible to transfer high tension sufficiently between the fibers, to enhance the fiber alignment in the carbon fiber bundle, and to make the stress transfer in the composite obtained from the carbon fiber bundle more uniform. In addition, when the average tearable length of the carbon fiber bundle is 600 mm or more, stress concentration points are hardly formed, and the tensile strength of a composite obtained from the carbon fiber bundle is hardly decreased. Any means can be adopted as a means of achieving such an entangled state of the carbon fiber bundle as long as the above-mentioned numerical range can be achieved. In particular, entangling treatment of the carbon fiber bundle using a fluid is preferably used.

Then, a method of manufacturing a carbon fiber bundle suitable to obtain the carbon fiber bundle will be described.

The method of manufacturing a carbon fiber bundle includes: a first stabilization process of stabilizing a polyacrylonitrile precursor fiber bundle for carbon fiber having a number of filaments of 30,000 or more and an average tearable length of 400 to 800 mm for 8 to 25 minutes until the ratio of the peak intensity at 1453 $cm^{-1}$ to the peak intensity at 1370 $cm^{-1}$ in the infrared spectrum is 0.98 to 1.10 to give a fiber bundle; a second stabilization process of stabilizing the fiber bundle obtained in the first stabilization process for 20 to 35 minutes until the ratio of the peak intensity at 1453 $cm^{-1}$ to the peak intensity at 1370 $cm^{-1}$ in the infrared spectrum is 0.60 to 0.65 and the ratio of the peak intensity at 1254 $cm^{-1}$ to the peak intensity at 1370 $cm^{-1}$ in the infrared spectrum is 0.50 to 0.65; a pre-carbonization process of pre-carbonizing the fiber bundle obtained in the second stabilization process in an inert atmosphere having a maximum temperature of 500 to 1000° C. at a stretch ratio of 1.00 to 1.10; and a carbonization process of carbonizing the fiber bundle obtained in the pre-carbonization process in an inert atmosphere having a maximum temperature of 1000 to 2000° C.

As a raw material used to manufacture the polyacrylonitrile precursor fiber bundle for carbon fiber (hereinafter sometimes simply referred to as "precursor fiber bundle for carbon fiber"), a polyacrylonitrile copolymer is used. The "polyacrylonitrile copolymer" refers to a material containing at least acrylonitrile as a main component of a polymer unit. The main component refers to a component that accounts for 90 to 100% by weight of the polymer unit.

In the manufacture of the precursor fiber bundle for carbon fiber, the polyacrylonitrile copolymer preferably contains a copolymerization component from the viewpoint of controlling the stabilization treatment. A preferable example of a monomer usable as a copolymerization component is a monomer containing at least one carboxylic acid group or amide group from the viewpoint of accelerating the stabilization. Examples of the monomer containing a carboxylic acid group include acrylic acid, methacrylic acid, itaconic acid, and alkali metal salts and ammonium salts thereof. Examples of the monomer containing an amide group include acrylamide.

In the manufacture of the precursor fiber bundle for carbon fiber, the method of manufacturing the polyacrylonitrile copolymer can be selected from known polymerization methods.

In the manufacture of the precursor fiber bundle for carbon fiber, either of a dry-jet wet spinning method and a wet spinning method may be used as the spinning method. A dry-jet wet spinning method that is advantageous to increase the knot strength of the obtained carbon fiber bundle is preferably used.

In using the dry jet wet spinning method, the spinning process preferably includes: an extruding process of extruding a spinning dope solution from a spinneret into a coagulation bath and spinning the dope solution by the dry-jet wet spinning method to produce a fiber; a water washing process of washing the fiber obtained in the extruding process in a water bath; a water bath stretching process of stretching the fiber obtained in the water washing process in the water bath; and a drying heat treatment process of subjecting the fiber obtained in the water bath stretching process to drying heat treatment and, if necessary, an additional steam stretching process of steam-stretching the fiber obtained in the drying heat treatment process. The order of these processes can be appropriately changed. The spinning dope solution is obtained by dissolving the above-mentioned polyacrylonitrile copolymer in a solvent capable of dissolving polyacrylonitrile such as dimethylsulfoxide, dimethylformamide, and dimethylacetamide.

The coagulation bath preferably contains a solvent used as a solvent of the spinning dope solution such as dimethylsulfoxide, dimethylformamide, and dimethylacetamide, and a coagulant. As the coagulant, those that do not dissolve the polyacrylonitrile copolymer and are compatible with the solvent used in the spinning solution can be used. Specifically, water is preferably used as the coagulant.

The water washing bath used in the water washing process is preferably a water washing bath having a temperature of 30 to 98° C. and having a plurality of stages.

The stretch ratio in the water bath stretching process is preferably 2 to 6 times.

After the water bath stretching process, it is preferable to apply an oil agent made of silicone or the like (silicone oil agent) to the fiber bundle for the purpose of preventing fusion between the single fibers. The silicone oil agent is preferably modified silicone, and is preferably one containing highly heat-resistant amino-modified silicone.

The drying heat treatment process can be performed by a known method. For example, an example of the drying temperature is 100 to 200° C.

A precursor fiber bundle for carbon fiber suitable to provide the carbon fiber bundle can be obtained by steam-stretching the fiber as necessary after the water washing process, the water bath stretching process, and the drying heat treatment process. The steam stretching is preferably performed in pressurized steam at a stretch ratio of 2 to 6 times.

It is also preferable to subject the precursor fiber bundle for carbon fiber to entangling treatment so that the precursor fiber bundle for carbon fiber may have an average tearable length of 400 to 800 mm. Controlling the average tearable length of the precursor fiber bundle within the above-mentioned range makes it possible to uniformize the tension applied inside the fiber bundle during the manufacture of the carbon fiber bundle among the single fibers in the bundle and, for example, to maintain the change of the crystal orientation caused by the heat treatment uniform between the single fibers. In addition, to control the tearable length of the carbon fiber bundle, it is preferable to control the average tearable length of the precursor fiber bundle for carbon fiber. To reduce the unevenness of tension in the fiber bundle, an average tearable length of 800 mm or less is sufficient. A shorter average tearable length is preferable because the heat treatment of the fiber bundle can be performed uniformly. If the average tearable length is less than 400 mm, stress concentration points tend to be formed in the fiber bundle. The average tearable length can be controlled within the above-mentioned range by following a known method, for example, Japanese Patent Laid-open Publication No. 2014-159564.

The single-fiber fineness of the precursor fiber bundle for carbon fiber is preferably 0.5 to 1.5 dtex, more preferably 0.5 to 0.8 dtex from the viewpoint of increasing the tensile strength of resin-impregnated strands and the tensile modulus of resin-impregnated strands of the carbon fiber bundle.

The number of filaments of the precursor fiber bundle for carbon fiber is preferably 30,000 or more, more preferably 35,000 or more to be equal to the number of filaments of the carbon fiber bundle. When the number of filaments of the precursor fiber bundle for carbon fiber is equal to the number of filaments of the carbon fiber bundle, voids between single fibers, that is, so-called bundle splitting in the carbon fiber bundle tend to be eliminated. Further, the larger the number of filaments of the precursor fiber bundle for carbon fiber is, the more easily the variation of physical properties of the carbon fiber bundle is reduced.

In the method of manufacturing a carbon fiber bundle, a carbon fiber bundle is obtained by subjecting a precursor fiber bundle for carbon fiber to a stabilization process, a pre-carbonization process, and a carbonization process. To increase the knot strength of the carbon fiber bundle and reduce the variation of the knot strength, at the time of subjecting the precursor fiber bundle for carbon fiber to the stabilization process, the conditions are controlled so that the obtained stabilized fiber may have a ratio of the peak intensity at 1453 $cm^{-1}$ to the peak intensity at 1370 $cm^{-1}$ in the infrared spectrum of 0.60 to 0.65 and a ratio of the peak intensity at 1254 $cm^{-1}$ to the peak intensity at 1370 $cm^{-1}$ in the infrared spectrum of 0.50 to 0.65. Peaks at 1453 $cm^{-1}$ in the infrared spectrum are derived from alkene, and decrease with the progress of stabilization. Peaks at 1370 $cm^{-1}$ and peaks at 1254 $cm^{-1}$ are peaks derived from stabilized structures (thought to be a naphthyridine ring structure and a hydrogenated naphthyridine ring structure, respectively), and increase with the progress of stabilization. In the stabilization process, in general, peaks derived from polyacrylonitrile are decreased as much as possible to increase the carbonization yield. In the method of manufacturing a carbon fiber bundle, however, the conditions of the stabilization process are set to intentionally leave many alkenes. A stabilized fiber bundle having such a structure is subjected to a pre-carbonization process to produce the carbon fiber bundle. Further, it is important to set the stabilization conditions so that the ratio of the peak intensity at 1254 $cm^{-1}$ to the peak intensity at 1370 $cm^{-1}$ may be 0.50 to 0.65. Peaks at 1254 $cm^{-1}$ are frequently observed at portions where the fiber bundle is insufficiently stabilized. When there are a large number of the structures, the knot strength tends to decrease. The peak intensity ratio decreases with the progress of stabilization, and the decrease at the initial stage is particularly large. Depending on the stabilization conditions, however, the peak intensity ratio may not be 0.65 or less even if the time is increased.

To satisfy these two peak intensity ratios within the intended ranges, the conditions should be set with attention being mainly paid to that the amount of the copolymerization component contained in the polyacrylonitrile copolymer that constitutes the precursor fiber bundle for carbon fiber is small, that the precursor fiber bundle for carbon fiber has a small fineness, and that the stabilization temperature is increased at the latter stage. Specifically, the precursor fiber bundle for carbon fiber is heat-treated until the ratio of the peak intensity at 1453 $cm^{-1}$ to the peak intensity at 1370 $cm^{-1}$ in the infrared spectrum is 0.98 to 1.10 (first stabilization process), and then heat-treated until the ratio of the peak intensity at 1453 $cm^{-1}$ to the peak intensity at 1370 $cm^{-1}$ in the infrared spectrum is 0.60 to 0.65 and the ratio of the peak intensity at 1254 $cm^{-1}$ to the peak intensity at 1370 $cm^{-1}$ in the infrared spectrum is 0.50 to 0.65 preferably at a temperature higher than that in the first stabilization process for a stabilization time of 20 to 35 minutes, preferably for 20 to 30 minutes (second stabilization process).

To shorten the stabilization time in the second stabilization process, the stabilization temperature should be adjusted to a high temperature. An appropriate stabilization temperature depends on the characteristics of the precursor fiber bundle for carbon fiber. It is preferable to control the center temperature of the precursor fiber bundle for carbon fiber preferably to 250 to 300° C., more preferably to 250 to 280° C., still more preferably to 250 to 270° C. to control the peak intensity ratios within the above-mentioned ranges of the infrared spectrum. The stabilization temperature does not have to be constant, and multistage temperature setting may be employed.

When there are three or more oxidation ovens, the treatment performed in the second and subsequent oxidation ovens is referred to as the second stabilization process. There is no limitation on the number of oxidation ovens to perform the stabilization process.

To increase the knot strength of the obtained carbon fiber bundle, it is preferable to increase the stabilization temperature and shorten the stabilization time. In the first stabilization process, it is preferable to perform the stabilization preferably for a stabilization time of 8 to 25 minutes, more preferably for 8 to 15 minutes at a stabilization temperature within the above-mentioned range.

The "stabilization time" means the time during which the fiber bundle stays in the oxidation oven, and the "stabilized fiber bundle" means a fiber bundle after the stabilization process and before the pre-carbonization process. In addition, the "peak intensity" is the absorbance at each wavelength obtained by sampling a small amount of the stabilized fiber, measuring the infrared spectrum of the fiber, and subjecting the obtained infrared spectrum to baseline correction, and the spectrum is not subjected to peak splitting. Further, the sample for measurement is diluted with KBr so that the sample may have a concentration of 0.67% by mass. As described above, the conditions of stabilization should be considered according to the preferable manufacturing method described later by measuring the infrared spectrum every time the stabilization condition settings are changed. Appropriate control of the infrared spectrum peak intensity ratios of the stabilized fiber enables control of the knot strength of the obtained carbon fiber bundle.

The stabilization process means to heat-treat the precursor fiber bundle for carbon fiber at 200 to 300° C. in an atmosphere containing oxygen.

The total treatment time of the stabilization process can be appropriately selected preferably at 28 to 55 minutes. More preferably, the total treatment time is 28 to 45 minutes.

In the pre-carbonization process of pre-carbonizing the fiber bundle obtained in the stabilization process, the obtained stabilized fiber bundle is pre-carbonized in an inert atmosphere having a maximum temperature of 500 to 1000° C. at a stretch ratio of 1.00 to 1.10. The stretch ratio is preferably 1.03 to 1.07. In such a temperature range, the microstructure hardly suffers from flaws due to stretching. When the stretch ratio in the pre-carbonization process is 1.00 or more, the reaction of forming the initial carbonized structure between the molecules inside the fiber is promoted, and a dense fiber structure can be formed. As a result, it is possible to increase the knot strength of the carbon fiber bundle. If the stretch ratio in the pre-carbonization process exceeds 1.10, high tension may be applied to the pre-carbonized fiber bundle to generate fuzz in some cases.

In the pre-carbonization process, it is preferable to heat-treat the fiber bundle until the stabilized fiber bundle comes to have a specific gravity of 1.5 to 1.8. Heat-treating the fiber bundle until the stabilized fiber bundle comes to have the above-mentioned specific gravity makes it easier to provide a composite having excellent tensile strength.

The pre-carbonized fiber bundle is carbonized in an inert atmosphere at a maximum temperature of 1000 to 2000° C. From the viewpoint of increasing the tensile modulus of resin-impregnated strands of the obtained carbon fiber bundle, it is preferable that the temperature of the carbonization process be higher. However, too high a temperature may decrease the knot strength. Therefore, it is preferable to set the temperature in consideration of both the conditions. The maximum temperature is more preferably 1200 to 1800° C., still more preferably 1200 to 1600° C.

The carbon fiber bundle obtained as described above is preferably subjected to oxidation treatment. The oxidation treatment introduces an oxygen-containing functional group. In the manufacturing method, when electrolytic surface treatment is performed as the oxidation treatment, gas phase oxidation, liquid phase oxidation, or liquid phase electrolytic oxidation can be used. Among them, liquid phase electrolytic oxidation is preferably used from the viewpoint of high productivity and capability of uniform treatment. The method of liquid phase electrolytic oxidation is not particularly limited, and a known method may be employed.

After the electrolytic surface treatment, the obtained carbon fiber bundle can be subjected to sizing treatment to impart convergency to the carbon fiber bundle. For the sizing agent, a sizing agent well compatible with the matrix resin used in the composite can be appropriately selected according to the type of the matrix resin.

Methods of measuring various physical properties are as follows.

Single-Fiber Loop Test

A single fiber having a length of about 10 cm is placed on a slide glass, 1 to 2 drops of glycerin is dropped on the center of the single fiber, and both ends of the single fiber are lightly twisted in the circumferential direction of the fiber to form a loop at the center of the single fiber. A cover glass is placed on the single fiber. The obtained specimen is put on a stage of a microscope, and shooting of a moving image is started under the conditions of a total magnification of 100 times and a frame rate of 15 frames/second. While adjusting the stage as appropriate so that the loop may not come out of the field of view, strain is applied to the single fiber until the single fiber fractures by pulling both the ends of the looped fiber at a constant speed in opposite directions with the ends being pushed against the slide glass with fingers. The frame just before loop fracture is specified by frame advance, and the width W of the loop just before loop fracture is measured by image analysis. The fiber diameter d is divided by W to calculate d/W. The number of tests n is 20. The value of E×d/W is obtained by multiplying the average of d/W by the tensile modulus of resin-impregnated strands, E.

Strand Tensile Test of Carbon Fiber Bundle

The tensile strength of resin-impregnated strands and the tensile modulus of resin-impregnated strands of the carbon fiber bundle are determined by the resin-impregnated strand test method of JIS-R-7608 (2004) according to the following procedure. As a resin formulation, "CELLOXIDE (registered trademark)" 2021P (manufactured by Daicel Chemical Industries, Ltd.)/boron trifluoride monoethylamine (manufactured by Tokyo Chemical Industry Co., Ltd.)/acetone=100/3/4 (parts by mass) are used. As the curing conditions, atmospheric pressure, a temperature of 125° C., and a time of 30 minutes are used. Ten resin-impregnated strands of a carbon fiber bundle are measured, and the average of the measured values is defined as the tensile strength of resin-impregnated strands or the tensile modulus of resin-impregnated strands. The strain is evaluated using an extensometer. The range of strain is 0.1 to 0.6%.

Knot Strength and Coefficient of Variation Thereof of Carbon Fiber Bundle

A grip having a length of 25 mm is attached to both ends of a carbon fiber bundle having a length of 150 mm to produce a test specimen. In the production of the test specimen, a load of $0.1\times10^{-3}$ N/denier is applied to the carbon fiber bundle for alignment. One knot is made at the midpoint of the test specimen, and the test specimen is subjected to a fiber bundle tensile test at a crosshead speed at tension of 100 mm/min. A total of 12 fiber bundles are subjected to the measurement. The average of 10 fiber bundles excluding the maximum value and the minimum value is used as the measured value, and the standard deviation of 10 values is used as the standard deviation of the knot strength. As the knot strength, a value obtained by dividing the maximum load value obtained in the tensile test by the average cross-sectional area of the carbon fiber bundles is used. For the coefficient of variation of the knot strength, a value that is obtained by dividing the standard deviation of the knot strength by the above-mentioned average and is expressed in percentage is used.

Intensity Ratio in Infrared Spectrum

A stabilized fiber to be measured is frozen and pulverized, and then 2 mg of the stabilized fiber is accurately weighed and collected. The stabilized fiber is well mixed with 300 mg of KBr, and the mixture is placed in a molding jig and pressurized with a pressing machine at 40 MPa for 2 minutes to produce a tablet for measurement. The tablet is set in a Fourier transform infrared spectrophotometer, and the spectrum of the tablet is measured in the range of 1000 to 2000 $cm^{-1}$. The background correction is performed by subtracting from each intensity the minimum value thereof so that the minimum value in the range of 1700 to 2000 $cm^{-1}$ may be zero. The spectrophotometer used as the Fourier transform infrared spectrophotometer is Paragon 1000 manufactured by PerkinElmer Japan Co., Ltd.

Average Tearable Length

The average tearable lengths of the precursor fiber bundle for carbon fiber and the carbon fiber bundle are both determined as follows. That is, as shown in The FIGURE, a fiber bundle 1 to be measured is cut into a length of 1160 mm, and one end 2 of the fiber bundle 1 is fixed to a horizontal table with an adhesive tape (the point is called a fixed point A). One end 3 of the fiber bundle 1 that is not fixed is divided into two by finger, and one of the divided ends of the fiber bundle is fixed to the table with an adhesive tape to not move in a state where the fiber bundle is strained (the point is called a fixed point B). The other one of the end 3 of the divided fiber bundle is moved along the table with the fixed point A as a supporting point to not slack, stopped at a position 4 where the linear distance from the fixed point B is 500 mm, and fixed to the table with an adhesive tape to not move (the point is called a fixed point C). The region surrounded by the fixed points A, B, and C is visually observed, and an entanglement point 5 farthest from the fixed point A is found. The length obtained by projecting the entanglement point 5 on the straight line connecting the fixed points A and B is read using a ruler with a smallest scale of 1 mm as a tearable length 6. The measurement is repeated 30 times, and the arithmetic average of the measured values is taken as the average tearable length. In this measurement method, the entanglement point farthest from the fixed point A is a point farthest in direct distance from the fixed point A and where three or more single fibers are entangled with each other with no slack.

Measurement of Amount of Abrasive Fuzz

Against a fixed chromium-plated stainless steel rod having a diameter of 12 mm, 200 mm of a carbon fiber bundle is abraded in a direction perpendicular to the axial direction of the stainless steel rod from one end of the fiber bundle to the other end thereof with 500 gf of tension being applied to the carbon fiber bundle. In the abrasion, the carbon fiber bundle is abraded over a distance of half the circumference of the stainless steel rod. After the carbon fiber bundle is reciprocated 20 times and abraded against the stainless steel rod a total of 40 times, the abraded carbon fiber bundle is sandwiched between two urethane sponges. A weight of 125 g is put on the urethane sponges so that the load may be applied to the entire surface of the urethane sponges, and the mass of the fuzz attached to the sponges after the abraded carbon fiber bundle is passed at a speed of 2 m/min is evaluated as the amount of abrasive fuzz.

Tensile Strength of Carbon Fiber-Reinforced Composite

The strand tensile test of the carbon fiber bundle described above is performed with the resin composition being changed as follows.

Resin Composition

Resorcinol epoxy (100 parts by weight)

Diethylenetriamine (39 parts by weight)

The curing conditions are 100° C. for 2 hours. For the measurement, the carbon fiber bundle abraded against the stainless steel rod in the measurement of the amount of fuzz is used. As the resorcinol epoxy, Denacol EX201 manufactured by Nagase ChemteX Corporation is used. As the diethylenetriamine, the one manufactured by Tokyo Chemical Industry Co., Ltd. is used.

EXAMPLES

Example 1

A monomer mixture consisting of 99.0% by mass of acrylonitrile and 1.0% by mass of itaconic acid was polymerized by solution polymerization using dimethylsulfoxide as a solvent to prepare a spinning solution containing a polyacrylonitrile copolymer having an intrinsic viscosity [η] of 2 and a concentration of 20% by mass. Coagulated fibers were obtained by a dry-jet wet spinning method of extruding the obtained spinning solution once into the air from a spinneret having 12,000 holes, and introducing the extruded spinning solution into a coagulation bath made of an aqueous solution of dimethylsulfoxide.

The coagulated fibers were washed with water in a bath at 50° C., and then stretched 3.5 times in two hot water baths. Then, to the fiber bundle obtained after the water bath stretching, an amino-modified silicone oil agent was applied, and the fiber bundle was subjected to drying densification treatment using a heating roller at 160° C. The number of single fibers was adjusted to 36,000, and then the fiber bundle was stretched 3.7 times in pressurized steam to make the total stretch ratio of the yarn 13 times. Then, the fiber bundle was subjected to entangling treatment by air having a fluid extrusion pressure of 0.35 MPa-G with a tension of 2 mN/dtex being applied to the fiber bundle to produce a precursor fiber bundle for carbon fiber having a number of single fibers of 36,000. The precursor fiber bundle for carbon fiber had a single-fiber fineness of 0.8 dtex and an average tearable length of 643 mm.

Then, the precursor fiber bundle for carbon fiber was subjected to stabilization treatment while being stretched at a stretch ratio of 1 in an oven in an air atmosphere under the conditions of a stabilization temperature of 250° C. and a stabilization time of 11 minutes for the first stabilization process and a stabilization temperature of 270° C. and a stabilization time of 21 minutes for the second stabilization process to produce a stabilized fiber bundle shown in Table 1.

In Table 1, the process of stabilization in the "first oven" corresponds to the first stabilization process, and the process of stabilization in the "second oven" corresponds to the second stabilization process.

The obtained stabilized fiber bundle was pre-carbonized in a nitrogen atmosphere having a maximum temperature of 900° C. while being stretched at a stretch ratio shown in Table 1 to produce a pre-carbonized fiber bundle. The obtained pre-carbonized fiber bundle was carbonized in a nitrogen atmosphere at a maximum temperature of 1500° C. while being stretched at a stretch ratio shown in Table 1. The obtained carbon fiber bundle was subjected to surface treatment and sizing agent coating treatment to prepare a final carbon fiber bundle. Physical properties of the final carbon fiber bundle are shown in Table 1.

Example 2

A stabilized fiber bundle was obtained as in Example 1 except that only the stabilization process was changed as follows. The precursor fiber bundle for carbon fiber was subjected to stabilization treatment while being stretched at a stretch ratio of 1 in an oven in an air atmosphere under the conditions of a stabilization temperature of 250° C. and a stabilization time of 11 minutes for the first stabilization process and a stabilization temperature of 270° C. and a stabilization time of 21 minutes for the second stabilization process to produce a stabilized fiber bundle. The subsequent pre-carbonization treatment and carbonization treatment were performed in the same manner as in Example 1 to produce a carbon fiber bundle.

Example 3

A stabilized fiber bundle was obtained as in Example 1 except that only the stabilization process was changed as follows. The precursor fiber bundle for carbon fiber was subjected to stabilization treatment while being stretched at a stretch ratio of 1 in an oven in an air atmosphere under the conditions of a stabilization temperature of 250° C. and a stabilization time of 11 minutes for the first stabilization process and a stabilization temperature of 265° C. and a stabilization time of 21 minutes for the second stabilization process to produce a stabilized fiber bundle. The subsequent pre-carbonization treatment and carbonization treatment were performed in the same manner as in Example 1 except that the stretch ratio in the pre-carbonization was 1.06 to produce a carbon fiber bundle. The obtained carbon fiber-reinforced composite had a tensile strength of 5.3 GPa.

Examples 4 to 6

A stabilized fiber bundle was obtained as in Example 1 except that only the stabilization process was changed as follows. The stabilization time condition in the first stabilization process and the second stabilization process was the same as in Example 3, and the stabilization temperature was changed so that the intensity ratio in the infrared spectrum may be the value shown in Table 1 to produce a stabilized fiber bundle. The subsequent pre-carbonization treatment and carbonization treatment were performed in the same manner as in Example 3 to produce a carbon fiber bundle. The results of evaluating the carbon fiber bundle are shown in Table 1.

Comparative Example 1

A stabilized fiber bundle was obtained as in Example 1 except that only the stabilization process was changed as follows. The precursor fiber bundle for carbon fiber was subjected to stabilization treatment while being stretched at a stretch ratio of 1 in an oven in an air atmosphere under the conditions of a stabilization temperature of 245° C. and a stabilization time of 15 minutes for the first stabilization process and a stabilization temperature of 255° C. and a stabilization time of 44 minutes for the second stabilization process to produce a stabilized fiber bundle. The subsequent pre-carbonization treatment and carbonization treatment were performed in the same manner as in Example 1 to produce a carbon fiber bundle. The amount of abrasive fuzz of the obtained carbon fiber bundle was larger than those of the carbon fiber bundles mentioned in the examples, and the carbon fiber bundle did not exhibit carbonization characteristics at a sufficiently high level and had a tensile strength of resin-impregnated strands of 5.9 GPa and a knot strength of 785 $N/mm^2$.

Comparative Example 2

A stabilized fiber bundle was obtained as in Example 1 except that only the stabilization process was changed as follows. The precursor fiber bundle for carbon fiber was subjected to stabilization treatment while being stretched at a stretch ratio of 1 in an oven in an air atmosphere under the conditions of a stabilization temperature of 230° C. and a stabilization time of 36 minutes for the first stabilization process and a stabilization temperature of 245° C. and a stabilization time of 71 minutes for the second stabilization process to produce a stabilized fiber bundle. The subsequent pre-carbonization treatment and carbonization treatment were performed in the same manner as in Example 1 to produce a carbon fiber bundle. The amount of abrasive fuzz of the obtained carbon fiber bundle was larger than those of the carbon fiber bundles mentioned in the examples, and the carbon fiber bundle did not exhibit carbonization characteristics at a sufficiently high level and had a tensile strength of resin-impregnated strands of 5.9 GPa and a knot strength of 814 $N/mm^2$.

Comparative Example 3

In Comparative Example 3, the number of filaments of the precursor fiber bundle for carbon fiber was adjusted to 24,000 to produce a precursor fiber bundle for carbon fiber, and the precursor fiber bundle for carbon fiber was heat-treated in the same manner as in Example 3 to produce a carbon fiber bundle. The obtained carbon fiber bundle had high quality, but did not exhibit high tensile strength of resin-impregnated strands and had a tensile strength of resin-impregnated strands of 5.9 GPa.

Comparative Example 4

The results of evaluating the carbon fiber bundle Panex 35 (manufactured by ZOLTEK Corporation) are shown in Table 1.

Comparative Example 5

In Comparative Example 5, the number of filaments of the precursor fiber bundle for carbon fiber was adjusted to 24,000, and the stabilization process was changed as follows to produce a stabilized fiber bundle. The precursor fiber bundle for carbon fiber was subjected to stabilization treatment while being stretched at a stretch ratio of 1 in an oven in an air atmosphere under the conditions of a stabilization temperature of 240° C. and a stabilization time of 36 minutes for the first stabilization process and a stabilization temperature of 250° C. and a stabilization time of 37 minutes for the second stabilization process to produce a stabilized fiber bundle. The subsequent pre-carbonization treatment and carbonization treatment were performed in the same manner as in Example 1 except that the stretch ratio in the pre-carbonization was 0.98 to produce a carbon fiber bundle. The results of evaluating the carbon fiber bundle are shown in Table 1.

Comparative Example 6

The stabilization, pre-carbonization, and carbonization treatment were performed in the same manner as in Comparative Example 5 except that the number of filaments of the precursor fiber bundle for carbon fiber was adjusted to 12,000 in Comparative Example 6 to produce a carbon fiber bundle. The results of evaluating the obtained carbon fiber bundle are shown in Table 1.

Comparative Example 7

Two carbon fiber bundles of Comparative Example 6 each having a number of filaments of 12,000 were gathered, and the gathered bundle having a number of filaments of 24,000 was evaluated. The results are shown in Table 1. The carbon fiber-reinforced composite had a tensile strength of 5.0 GPa, which was lower than that of Example 3 having a comparable tensile strength of resin-impregnated strands.

Comparative Example 8

Three carbon fiber bundles of Comparative Example 6 each having a number of filaments of 12,000 were gathered, and the gathered bundle having a number of filaments of 36,000 was evaluated. The results are shown in Table 1.

TABLE 1

| | Intensity ratio in Infrared spectrum | | | | | |
|---|---|---|---|---|---|---|
| | After stabilization in first oven | After stabilization in second oven | | Number of | Pre-carbonization | Carbonization |
| | 1453/1370 $cm^{-1}$ — | 1453/1370 $cm^{-1}$ — | 1254/1370 $cm^{-1}$ — | filaments number | stretch ratio — | stretch ratio — |
| Example 1 | 1.01 | 0.61 | 0.59 | 36000 | 1.03 | 0.95 |
| Example 2 | 1.01 | 0.60 | 0.59 | 36000 | 1.03 | 0.95 |
| Example 3 | 1.01 | 0.64 | 0.59 | 36000 | 1.06 | 0.95 |
| Example 4 | 1.00 | 0.61 | 0.60 | 36000 | 1.06 | 0.95 |
| Example 5 | 1.00 | 0.62 | 0.60 | 36000 | 1.06 | 0.95 |
| Example 6 | 1.00 | 0.60 | 0.60 | 36000 | 1.06 | 0.95 |
| Comparative Example 1 | 1.01 | 0.67 | 0.61 | 36000 | 1.03 | 0.95 |
| Comparative Example 2 | 0.95 | 0.62 | 0.59 | 36000 | 1.03 | 0.95 |
| Comparative Example 3 | 1.01 | 0.64 | 0.59 | 24000 | 1.06 | 0.95 |
| Comparative Example 4 | — | — | — | 50000 | — | — |
| Comparative Example 5 | 0.87 | 0.63 | 0.60 | 24000 | 0.98 | 0.95 |
| Comparative Example 6 | 0.87 | 0.63 | 0.60 | 12000 | 0.98 | 0.95 |
| Comparative Example 7 | — | — | — | 24000 | — | — |
| Comparative Example 8 | — | — | — | 36000 | — | — |

| | Carbon fiber bundle | | | | | | | | |
|---|---|---|---|---|---|---|---|---|---|
| | Amount of fuzz/ 200 mm mg | E × d/W GPa | Welbull shape parameter m of E × d/W — | Single-fiber diameter μm | Average tearable length mm | Knot strength $N/mm^2$ | Coefficient of variation of knot strength — | Tensile strength of resin-impregnated strands GPa | Tensile modulus of resin-impregnated strands GPa |
| Example 1 | 0.53 | 13.3 | 15 | 5.69 | 823 | 845 | 7.9% | 6.1 | 269 |
| Example 2 | 0.34 | 13.4 | 22 | 5.70 | 794 | 837 | 9.6% | 6.5 | 277 |
| Example 3 | 0.65 | 13.9 | 17 | 5.58 | 871 | 929 | 3.5% | 6.2 | 281 |
| Example 4 | — | 14.0 | 12 | 5.64 | 799 | 984 | 3.5% | 6.6 | 279 |
| Example 5 | — | 11.8 | 17 | 5.62 | 724 | 956 | 4.7% | 6.2 | 277 |
| Example 6 | — | 13.1 | 30 | 5.65 | 763 | 970 | 5.2% | 6.4 | 273 |
| Comparative Example 1 | 1.25 | 12.4 | 11 | 5.62 | 983 | 785 | 6.8% | 5.9 | 268 |
| Comparative Example 2 | 1.12 | 13.7 | 15 | 5.70 | 851 | 814 | 11.5% | 5.9 | 270 |
| Comparative Example 3 | 0.35 | 13.6 | 20 | 5.62 | 867 | 852 | 2.2% | 5.9 | 277 |
| Comparative Example 4 | 2.25 | 8.3 | 7 | 7.22 | 885 | 340 | 14.0% | 4.1 | 237 |
| Comparative Example 5 | 0.75 | 12.3 | 14 | 5.55 | 841 | 875 | 6.7% | 6.0 | 296 |
| Comparative Example 6 | 0.95 | 14.2 | 13 | 5.55 | 848 | 836 | 10.0% | 6.2 | 290 |
| Comparative Example 7 | 1.11 | 14.2 | 13 | 5.55 | 848 | 730 | 14.2% | 6.2 | 290 |
| Comparative Example 8 | 1.36 | 14.2 | 13 | 5.55 | 848 | 792 | 15.7% | 6.2 | 290 |

"Pre-carbonization stretch ratio" and "Carbonization stretch ratio" mean the stretch ratio in the pre-carbonization process and the stretch ratio in the carbonization process, respectively.

The invention claimed is:

1. A carbon fiber bundle comprising 35,000 or more filaments, wherein the carbon fiber bundle has a tensile modulus of resin-impregnated strands of 265 to 300 GPa, a tensile strength of resin-impregnated strands of 6.4 GPa or more, a knot strength of 820 $N/mm^2$ or more.

2. The carbon fiber bundle according to claim 1, having a knot strength of 900 $N/mm^2$ or more.

3. The carbon fiber bundle according to claim 1, having a coefficient of variation represented by a ratio of a standard deviation to an average of the knot strength of 6% or less.

4. The carbon fiber bundle according to claim 1, having a coefficient of variation represented by a ratio of a standard deviation to an average of the knot strength of 5% or less.

5. The carbon fiber bundle according to claim 1, having a product E×d/W of 13.0 GPa or more, and a Weibull shape parameter m in a Weibull plot of E×d/W of 12 or more, wherein d/W is a ratio of a single-fiber diameter d to a loop diameter W just before loop fracture as evaluated by a single-fiber loop test, and E is a tensile modulus of resin-impregnated strands.

6. The carbon fiber bundle according to claim 1, having an average tearable length of 600 to 900 mm.

7. The carbon fiber bundle according to claim 2, having a coefficient of variation represented by a ratio of a standard deviation to an average of the knot strength of 6% or less.

8. The carbon fiber bundle according to claim 2, having a coefficient of variation represented by a ratio of a standard deviation to an average of the knot strength of 5% or less.

9. The carbon fiber bundle according to claim 2, having a product E×d/W of 13.0 GPa or more, and a Weibull shape parameter m in a Weibull plot of E×d/W of 12 or more, wherein d/W is a ratio of a single-fiber diameter d to a loop diameter W just before loop fracture as evaluated by a single-fiber loop test, and E is a tensile modulus of resin-impregnated strands.

10. The carbon fiber bundle according to claim 3, having a product E×d/W of 13.0 GPa or more, and a Weibull shape parameter m in a Weibull plot of E>d/W of 12 or more, wherein d/W is a ratio of a single-fiber diameter d to a loop diameter W just before loop fracture as evaluated by a single-fiber loop test, and E is a tensile modulus of resin-impregnated strands.

11. The carbon fiber bundle according to claim 4, having a product E×d/W of 13.0 GPa or more, and a Weibull shape parameter m in a Weibull plot of E×d/W of 12 or more, wherein d/W is a ratio of a single-fiber diameter d to a loop diameter W just before loop fracture as evaluated by a single-fiber loop test, and E is a tensile modulus of resin-impregnated strands.

12. The carbon fiber bundle according to claim 2, having an average tearable length of 600 to 900 mm.

13. The carbon fiber bundle according to claim 3, having an average tearable length of 600 to 900 mm.

14. The carbon fiber bundle according to claim 11, having an average tearable length of 600 to 900 mm.

15. The carbon fiber bundle according to claim 12, having an average tearable length of 600 to 900 mm.

16. The carbon fiber bundle according to claim 1, wherein an amount of fuzz is 0.34 to 0.65 mg/200 mm.

* * * * *